United States Patent [19]

LaBair

[11] Patent Number: 4,726,282

[45] Date of Patent: Feb. 23, 1988

[54] FIXTURE CYLINDER WITH PROXIMITY SWITCHES MOUNTED ON END CAPS WITHOUT SPACERS

[75] Inventor: Richard L. LaBair, Pontiac, Mich.

[73] Assignee: Peninsular, Inc., Roseville, Mich.

[21] Appl. No.: 861,860

[22] Filed: Apr. 28, 1986

[51] Int. Cl.[4] ..... F15B 15/28

[52] U.S. Cl. ..... 92/5 R; 92/159

[58] Field of Search ..... 92/5 R, 159; 200/82 R, 200/82 A, 82 E

[56] References Cited

U.S. PATENT DOCUMENTS

| | | | |
|---|---|---|---|
| D. 173,065 | 9/1954 | Darr | D15/7 |
| D. 264,972 | 6/1982 | McMillin et al. | D15/7 |
| 385,319 | 6/1888 | North | D15/7 X |
| 1,596,356 | 8/1926 | Hughes | 92/159 X |
| 2,336,240 | 12/1943 | Gavin | 92/159 |
| 2,349,253 | 5/1944 | Edmund | 92/159 X |
| 4,021,027 | 5/1977 | Blatt . | |
| 4,316,145 | 2/1982 | Tarn | 137/553 X |
| 4,458,889 | 7/1984 | McPherson et al. . | |
| 4,632,018 | 12/1986 | Lymburner | 92/5 R |
| 4,681,992 | 7/1987 | Kazmierski | 200/82 E |

FOREIGN PATENT DOCUMENTS

| | | | |
|---|---|---|---|
| 0044287 | 1/1982 | European Pat. Off. | 92/5 R |
| 2342419 | 10/1977 | France | 92/5 R |
| 1202663 | 8/1970 | United Kingdom | 251/129.04 |

OTHER PUBLICATIONS

Fisher A Style AP Model Cylinder (5 sheets); 7/1977.
Lincoln Controls Hydraulic Pneumatic Systems & Equipment Catalogue (5/1982), p. 186, Sheffer Series MH Hydraulic Trunnion Front Mount Style TF.
Bellows-Valvair Brochure (5/1966) front page "Air Motor".
Stellhorn Catalogue (8/1982), p. 104, Air-Hydraulic Cylinder.
ISI Manufacturing, Inc. brochure entitled "Power and Manual Industrial Clamps".

*Primary Examiner*—A. Michael Chambers
*Assistant Examiner*—John C. Fox
*Attorney, Agent, or Firm*—Harness, Dickey & Pierce

[57] ABSTRACT

A fixture cylinder is provided that permits the use of integrally mounted proximity switches with the same fixed probe lengths on both end caps without requiring the use of spacers. The cylinder includes a body in which a piston assembly is slideably mounted about a longitudinal piston axis in a bore in the body. The piston assembly has a piston head, piston rod and a pair of hubs of equal diameter on opposite sides of the piston head. First and second end caps are provided on opposite ends of the body. Each end cap has a plurality of outer edges and a generally flat mounting surface is provided on one edge thereof for receiving a proximity switch. An aperture perpendicularly extends through each end cap and communicates with the bore in the body of the piston assembly. Two substantially identical proximity switches having generally flat mounting surfaces and the same fixed probe lengths are employed. The proximity switches are secured to the end caps so that the respective mounting surfaces abut and precisely define the distance that the probes extend towards the piston hubs in the bore.

15 Claims, 10 Drawing Figures

FIXTURE CYLINDER WITH PROXIMITY SWITCHES MOUNTED ON END CAPS WITHOUT SPACERS

BACKGROUND AND SUMMARY OF THE INVENTION

The present invention relates to cylinders and, more particularly, to fixture cylinders having proximity switches mounted to the end caps.

As industry moves more and more into automated robotic systems, applications for fixture cylinders become ever increasing. In the automotive industry, fixture cylinders play a large role in moving parts along an automated assembly line. Fixture cylinders may be adapted to move in a number of different directions accomplishing several different tasks. Thus, these movements enable the fixture cylinder to be utilized in a number of different applications along an assembly line. Cylinders having mounting means on their end caps are generally referred to in the industry as fixture cylinders because they are usually mounted to fixtures used on the assembly line or the like for performing operations on the workpieces.

Generally, air cylinders move parts weighing several hundred pounds. Also, air cylinders are preferred over hydraulic cylinders due to their appealing cleanliness characteristics. When line breakage occurs in an air cylinder system, the air supply is simply turned off and no mess or damage occurs; when a line breakage occurs in a hydraulic cylinder system there is a large cleanup project still remaining after the hydraulic fluid supply to the cylinder has been turned off. Although possessing outstanding cleanliness characteristics, prior air cylinders used in automation applications have several disadvantages. Generally, the air cylinders presently used in the field are of a hydraulic cylinder design and thus are very inefficient as air cylinders. With the movement to computer numeric controls, the prior air cylinders require numerous different spacer members to enable a proximity switch to be functionally mounted on the air cylinders. Also, the spacer members add to the overall height, weight, and bulkiness of the cylinders. With the addition of different spacer members onto the air cylinders, for accommodating proximity switches, two identical proximity switches may be utilized on a single air cylinder for controlling the stroke of the air cylinder. Further, the end caps of these cylinders are generally heavy machined parts adding to the overall weight of the air cylinder.

An air cylinder, known in the field as a Fisher cylinder, exists which was originally designed by Fisher Body as an air cylinder having end caps casted from a ductile or steel material. While having good efficiency characteristics, the Fisher cylinder does not meet National Fluid Power Association (NFPA) specifications and thus the Fisher cylinder is not interchangeable in standard equipment utilizing NFPA specification air cylinders. Also, the Fisher cylinder is not readily adaptable for the addition of proximity switches which limits the Fisher cylinder's use in computer numeric control applications.

Accordingly, the present invention overcomes the disadvantages of the above art. The new and improved air cylinder provides the art with an interchangeable air cylinder having end caps formed from a ductile material which are interchangeable with NFPA cylinders. Also, the present invention provides the art with an air cylinder which eliminates the use of spacer members for accommodating the proximity switches. Thus, the present invention enables the air cylinder to utilize two identical proximity switches for sensing the stroke of the piston.

In accordance with the teachings of the preferred embodiment of this invention, a fixture cylinder is provided that permits the use of integrally mounted proximity switches with the same fixed probe lengths on both end caps without requiring the use of spacers. The cylinder includes a body in which a piston assembly is slidably mounted about a longitudinal piston axis in a bore in the body. The piston assembly has a piston head, piston rod and a pair of hubs on opposite sides of the piston head. First and second end caps are provided on opposite ends of the body. Each end cap has a plurality of outer edges and a generally flat mounting surface is provided on one edge thereof for receiving a proximity switch. An aperture perpendicularly extends through each end cap and communicates with the bore in the body of the piston assembly. Two substantially identical proximity switches having generally flat mounting surfaces and fixed probe lengths are employed. Means are provided for securing the proximity switches to the end caps so that the respective mounting surfaces abut and precisely define the distance that the probes extend towards the piston hub in the bore.

From the following description and claims taken in conjunction with the accompanying drawings, other objects and advantages of the present invention will become apparent to one skilled in the art.

DETAILED DESCRIPTION OF THE PREFERRED EMBODIMENT

Figure 1:
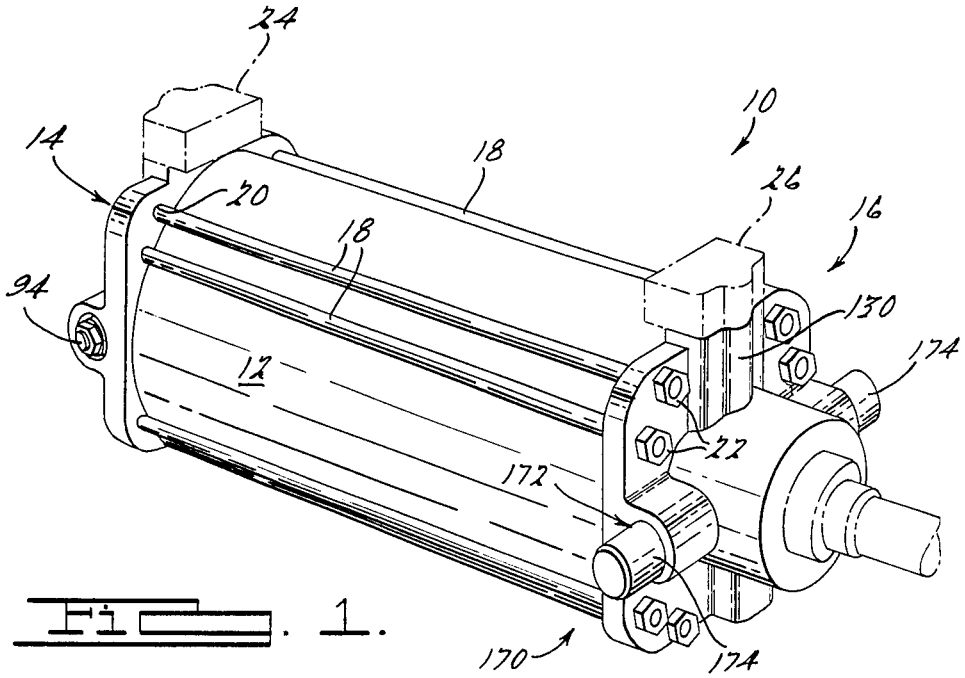
FIG. 1 is a perspective view of an air cylinder made in accordance with the teachings of the present invention.
Figure 2:
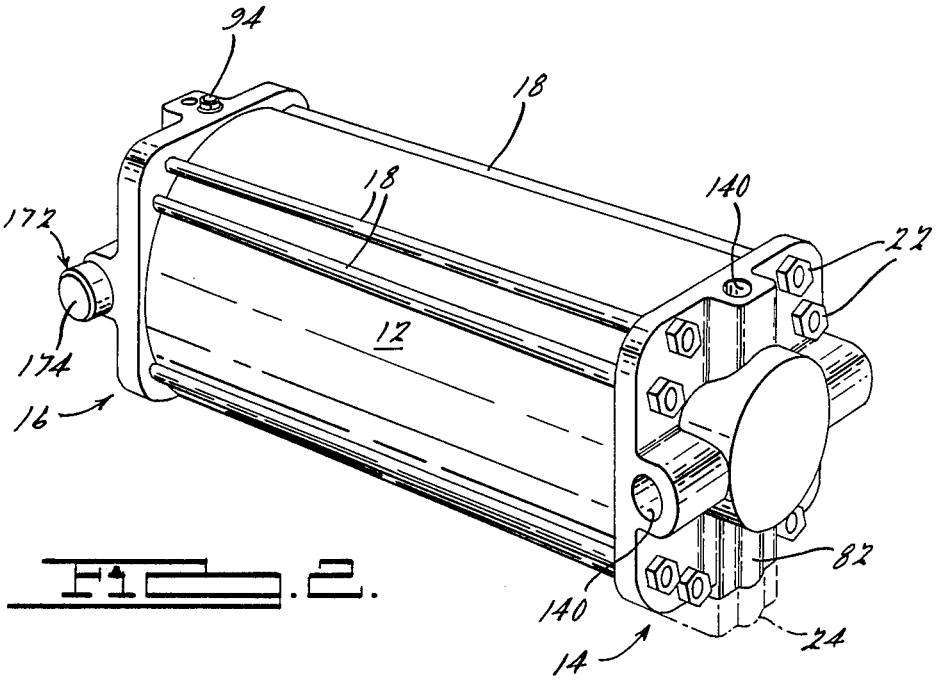
FIG. 2 is a perspective view of the air cylinder shown in FIG. 1 taken from a bottom rear corner thereof.
Figure 3:
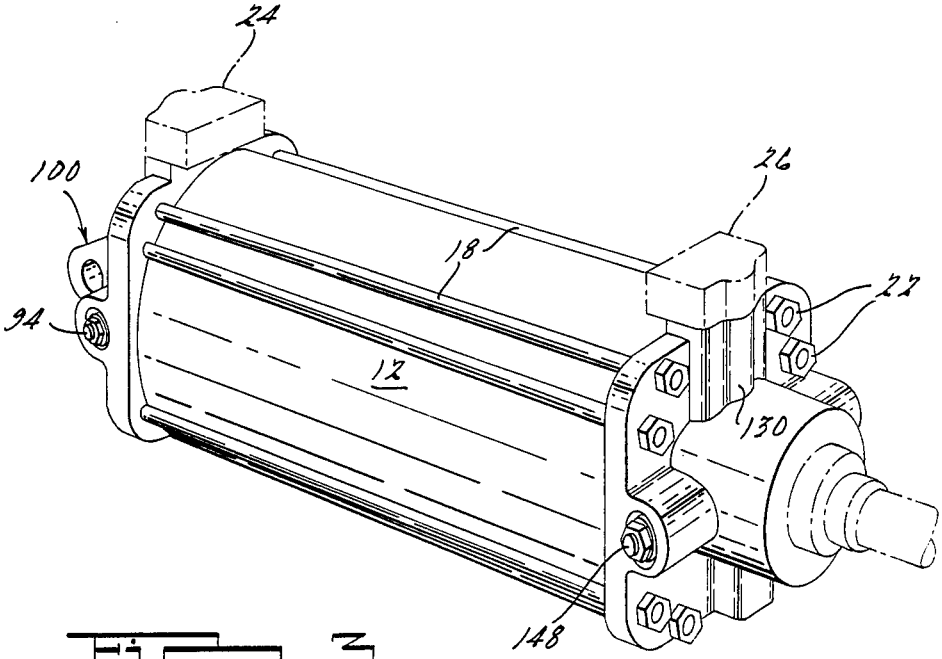
FIG. 3 is a perspective view of another air cylinder made in accordance with the teachings of the present invention.
Figure 4:
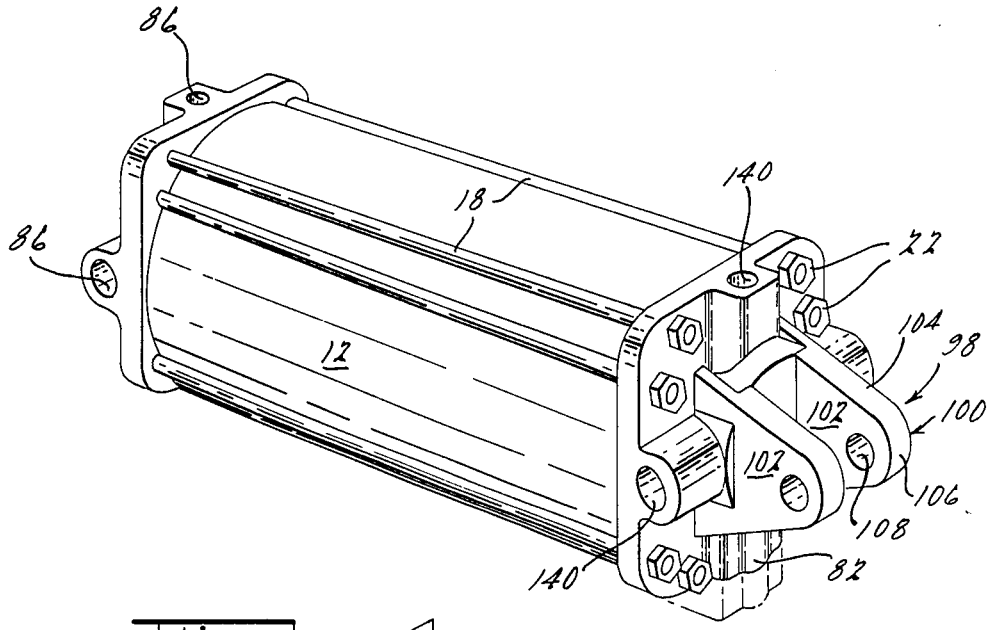
FIG. 4 is a perspective view of the embodiment of FIG. 3 taken from a bottom rear corner thereof.

The FIGS. illustrate an air cylinder which is designated by reference numeral (10). The air cylinder (10) includes a body portion (12), a first end cap (14) positioned on the back end of the body portion (12), and a second end cap (16) positioned on the front end of the body portion (12). The end caps (14) and (16) are secured onto the ends of the body portion (12) by a plurality of tie rods (18). The tie rods (18) are elongated metallic members having a threaded portion (20) on each end projecting through the end caps (14) and (16). Nuts (22) are threadily received on the thread portions (20) of the tie rods (18) for securing the end caps (14) and (16) to the body portion (12) of the air cylinder (10). In another embodiment, either of the end caps (14) or (16) may have threaded bores for receiving the threaded portion (20) of the tie rods (18). Switch mechanisms (24) and (26) are typically associated with a computer for sensing the stroke of the air cylinder (10).

Figure 5:
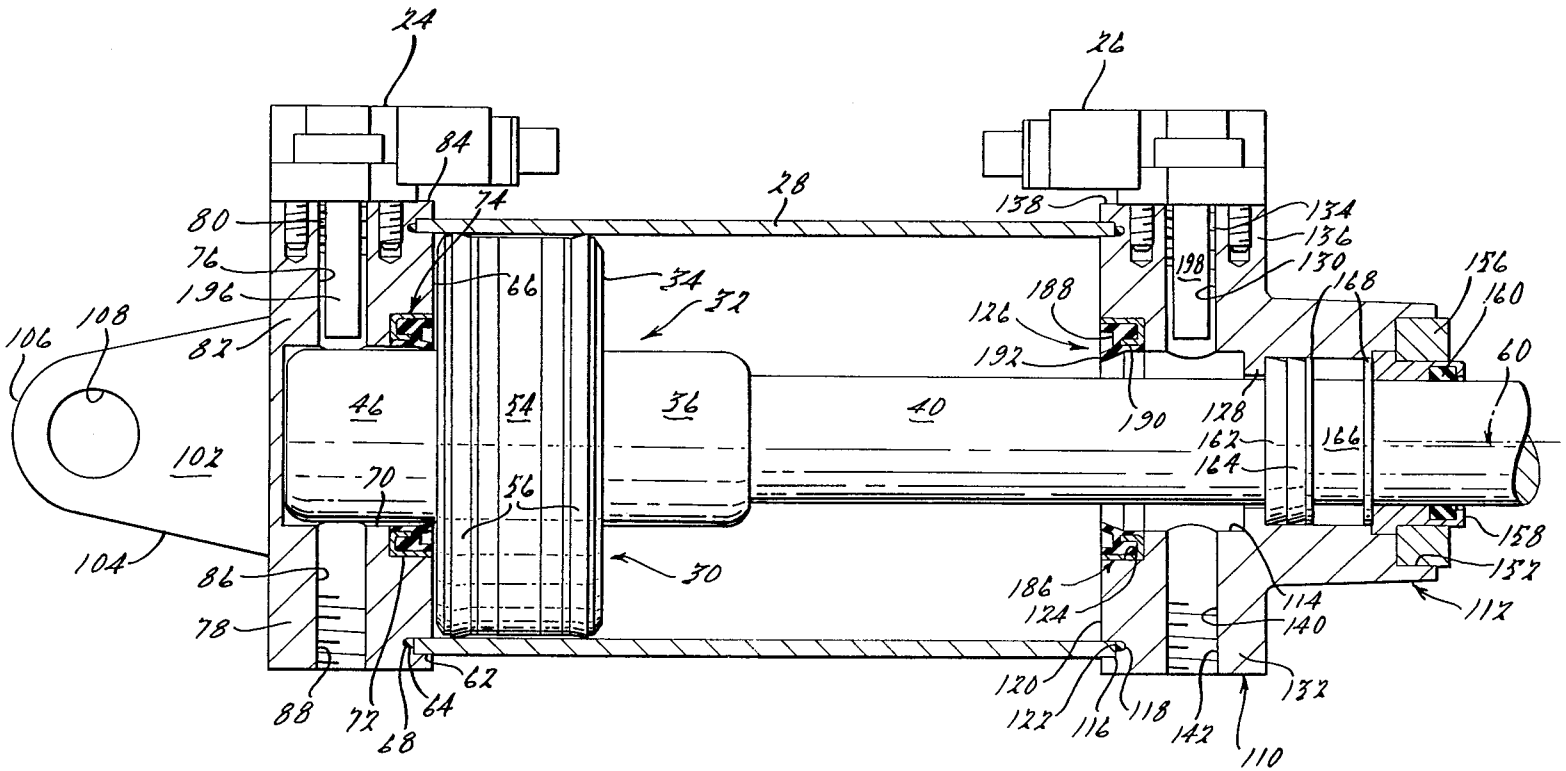
FIG. 5 is a longitudinal cross-sectional view of the embodiment of FIG. 3.

Generally, the body portion (12) is comprised of an elongated cylindrical tube. As best shown in FIG. 5, the wall (28) of the body portion (12) is usually formed from a metallic material, such as steel, and has a predetermined thickness. The inside diameter of the body portion (12), known in the industry as the cylinder bore, is sized to provide a specific force desired.

Figure 6:
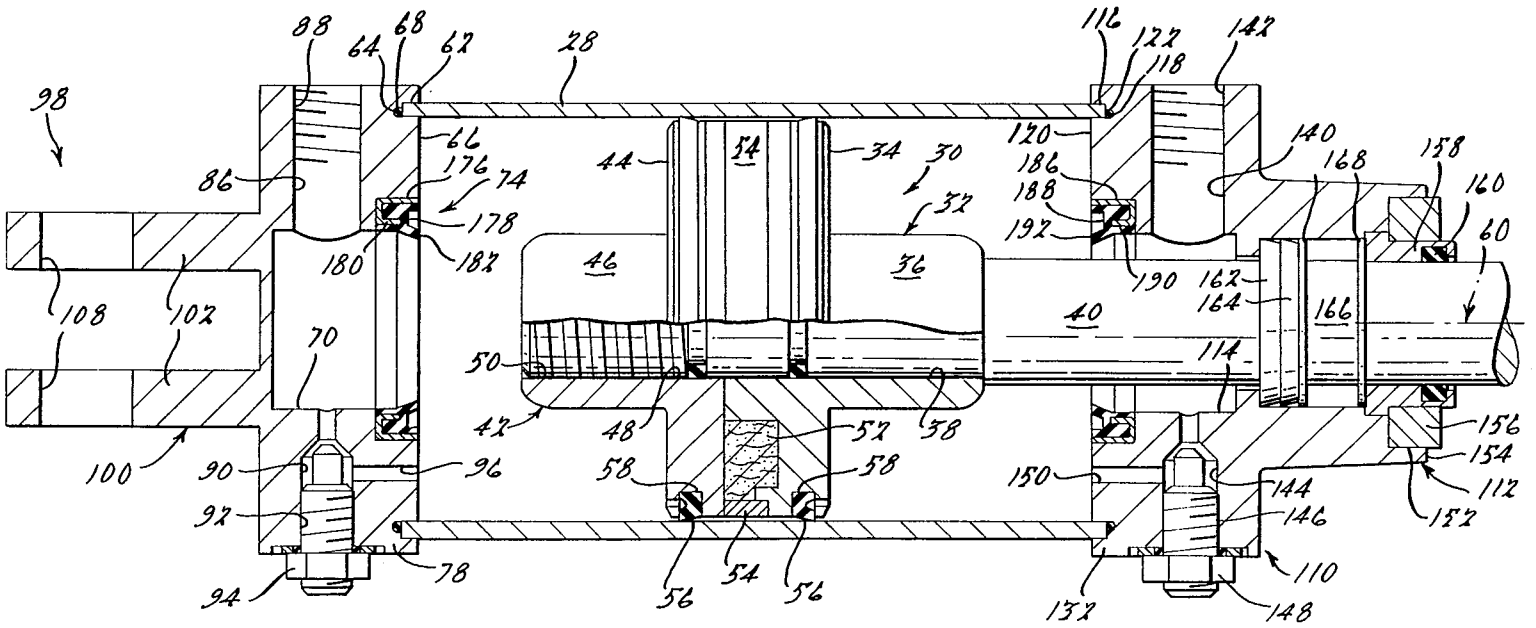
FIG. 6 is a cross-sectional view similar to FIG. 5 with the piston partially through a stroke and the cylinder rotated 90 degrees.

A piston (30), having a projection piston rod (40), is slidably positioned in the body portion (12) of the air cylinder (10). The piston (30) is of a two piece construction, as best seen in FIG. 6. The first half (32) of the piston (30) has a front side (34) and a first hub portion (36) adjacent to the front side (34). A bore (38) runs through both the front side (34) and first hub portion (36) for enabling the first half (32) of the piston (30) to be slid onto the piston rod (40). The second half (42) of the piston (30) has a back side (44) and a second hub portion (46) adjacent to the back side (44). A bore (48) runs through both the back side (44) and a second hub portion (46). The bore (48) has a threaded portion (50) for enabling the second half (42) of the piston (30) to be threadily received onto the piston rod (40). The second half (42) of the piston (30) secures both halves of the piston onto the rod (40).

A reservoir (52) is formed between the piston halves (32) and (42). The reservoir (52) is packed with grease for lubricating the body (12) of the cylinder (10). A piston ring (54) is positioned over the reservoir (52). The ring (54) is manufactured from a sintered bronze material. The sintered bronze enables the grease, once it is partially liquified from the heat of the working cylinder, to seep into the body portion (12). Also, a gap is positioned between the ring (54) and the piston halves (32) and (42) enabling the grease to escape into the body portion (12) for lubricating the cylinder (10).

The piston (30) has a pair of piston seals (56), positioned in a peripheral groove (58) on the piston (30), for improving the sealing of the piston (30) in the body portion (12) of the air cylinder (10). The seals (56) are generally manufactured from a polymeric material.

The piston rod (40), having a major axis (60), extends from the piston (30). The rod (40) extends through the second end cap (16) and may have an externally or internally threaded end on the free end of the rod for coupling the rod with a conventional fitting. The rod (40) is elongated and has a predetermined length. The length of the rod (40) is determined by the desired stroke and the task to be performed by the air cylinder (10). The body portion (12) and tie rods (18) also vary in length with the piston rod (40).

The hub portions (36) and (46) are enabled diameter portions of the piston halves (32) and (42). The outside diameter of the hub portions (36) and (46) are substantially equal to one another. As will be described herein, the hub portions (36) and (46) activate the switch mechanisms (24) and (26) for sensing the stroke of the piston rods.

The first end cap (14), or rear cap, has a pair of peripheral grooves (62) and (64) on its interior surfce (66) for enabling the wall (28) of the body portion (12) and a polymeric seal (68), preferably a rubber O-ring, to interfit into the end cap (14). A central bore (70) projects into the end cap (14). The bore (70) does not penetrate through the entire end cap (14). An enlarged bore (72), concentric with the central bore (70), is adjacent the interior surface (66) of end cap (14). A cushion seal member (74) is positioned in the enlarged bore (72) for providing a means for cushioning the piston hub (46) when the piston hub (46) enters into the end cap (14). The central bore (70) enables the second hub portion (46) to enter into the central bore (70) for activating switch (24), which will be described herein.

The end cap (14) has at least one bore (76) through the end cap wall (78). The bore (76) is substantially perpendicular to and in communication with the central bore (70). The bore (76) generally has a threaded portion (80). The end cap plate portion or wall (78) has a boss (82) integrally formed into the wall (78). The boss (82) has a planar surface (84) which is positioned at a predetermined distance from the major axis (60) of the piston rod (40). The planar surface (84) provides a securement surface for the switch (24). The switch (24) is secured onto the planar surface (84) by conventional means, such as screws. The end cap (14) has at least a second bore (86) through the end cap wall (78). The bore (86) is substantially perpendicular to and in communication with the central bore (70). The bore (86) generally has a threaded portion (88) which provides the end cap (14) with a mechanism for coupling an air supply conduit to the end cap (14) for supplying air to and removing air from the air cylinder (10).

The end cap (14) may have a third bore (90) through the end cap wall (78). The bore (90) is substantially perpendicular to and in communication with the central bore (70). The bore (90) generally has a threaded portion (92) which provides the end cap (14) with a mechanism for coupling a cushion screw (94) into the end cap (14). The cushion screw (94) is threadily adjustable in bore (90) for controlling the exit air in the cylinder (10). The bore (90) is associated with a bore (96), which enables compressed air to exit the body portion (12) once the hub (46) enters into a substantially air tight relationship with the cushion seal (74). Thus, the piston (30) may proceed to a position adjacent to the interior surface (66) of the end cap (14) finishing the stroke of the cylinder (10).

A mounting mechanism (98) may be secured on the first end cap (14) for positioning the air cylinder (10) in its desired orientation. The mounting mechanism (98) may be a clevis mount (100) as best seen in FIGS. 3, 4, 5 and 6. The clevis mount (100) is formed in the end cap (14) and is comprised of a pair of wall members (102) projecting from the exterior surface of the end cap (14). The wall members (102) have inward slanting sides (104), rounded end (106), and an aperture (108) through wall members (102) for securing a pivot rod in clevis mount (100).

The second end cap (16), or front cap, has a securement portion (110), and a projection portion (112). A central bore (114) passes through both portions (110) and (112). The securement portion (110) has a pair of peripheral grooves (116) and (118) on the interior surface (120) of the securement portion (110) for enabling the wall (28) of the body portion (12) and a polymeric seal (122), preferably an O-ring, to interfit into the end cap (16). An enlarged bore (124), adjacent to the interior surface (120) of the securement portion (110) and concentric with the central bore (114), enables a cushion seal member (126) to be positioned on the interior surface (120) of the securement portion (110). The cushion seal member (126) provides the interior surface (120) with a means for cushioning the piston hub (36) when the piston hub (36) enters into the end cap (16). A peripheral flange (128) extends into the central bore (114). The flange (128) provides the end cap (16) with a retaining means for securing the seals (162) and (164), bearing (166), and bushing (158) in position. Also, the flange (128) provides the end cap (16) with a divider between the securement and projection portions (110) and (112).

The securement portion (110) has at least one bore (130), substantially perpendicular to and in communication with the central bore (114), in the wall (132) of the projection portion (110). The bore (130) generally has a threaded portion (134). The securement portion (110) has a boss (136) integrally formed into the wall (132). The boss (136) has a planar surface (138) which is positioned a predetermined distance from the major axis (60) of the piston rod (40). The planar surface (138) provides a securement surface for the switch (26). The planar surfaces (84) and (138) are spaced at a substantially equal distance from the major axis (60) of the piston rod (40). The securement portion (110) has at least a second bore (140), substantially perpendicular to and in communication with the central bore (114), in the wall (132) of the projection portion (110). The bore (140) generally has a threaded portion (142) which provides the end cap (16) with a means for coupling an air supply conduit to the end cap (16) for supplying air to and removing air from the air cylinder (10).

The securement portion (110) may have a third bore (144) through the cap wall (132). The bore (144) is substantially perpendicular to and in communication with the central bore (114). The bore (144) generally has a threaded portion (146) which provides the securement portion (110) with a mechanism for coupling a cushion screw (148) into the securement portion (110). The cushion screw (148) is threadily adjustable in bore (144) for controlling the exit air in the cylinder (10). The bore (144) is associated with a bore (150), which enables compressed air to exit the body portion (12) once the hub (36) enters into a substantially air tight relationship with the cushion seal (126). Thus, the piston (30) may proceed to a position adjacent to the interior surface (120) of the end cap (16) finishing the stroke of the cylinder (10).

The projection portion (112) has an enlarged bore (152) concentric with the central bore (114) and adjacent to the exterior surface (154) of the projection portion (112). A retaining ring (156) is positioned in the enlarged bore (152) for retaining a bushing (158) in the projection portion (112) of the end cap (16). The bushing (158) has a sealing member (160) positioned on the interior surface of the bushing (158) for sealing the air cylinder (10). A second and third sealing member (162) and (164) are positioned in the central bore (114) adjacent the peripheral flange (128) for further sealing the central bore (114) against leaks in the air cylinder (10). A grease bearing (166) is positioned on the piston rod (40) adjacent to the bushing (158). The bearing (166) has a pair of peripheral flanges (168). The bearing (166) is packed with grease between the two flanges (168). The bearing (166) is manufactured from sintered bronze and has a clearance gap between the flanges (168) and the bore (114) for enabling grease to escape from the bearing (166) lubricating the piston rod (40).

A mounting mechanism (170) may be secured on the second end cap (16) for positioning the air cylinder (10) in its desired orientation. The mounting mechanism (170) may be a trunion mount (172) as best seen in FIG. 1. The trunion mount (172) is formed in the end cap (16) and is comprised of a pair of projection cylindrical members (174). The members (174) interlock with a conventional pivot receptical for mounting the air cylinder (10) in its desired orientation.

The cushion seal members (74) and (126) are comprised of housing rings (176) and (186) and seals (178) and (188), respectively. The housing rings (176) and (186) are preferably manufactured from a metallic material. A continuous flange (180) and (190) extends radially inward from the housing rings (176) and (186) for maintaining the seals (178) and (188) in the housing rings (176) and (186). The seals (178) and (188) are preferably manufactured from a polymeric material. The seals (178) and (188) have an angular radial inward flange (182) and (192) projecting into the central bore. The flanges (182) and (192) contact the piston for cushioning the piston hubs (36) and (46) as they enter into the end caps (14) and (16).

The cushion seals (74) and (126) are inserted into enlarged bores (72) and (124) such that the ring flanges (180) and (190) are positioned adjacent the walls (184) and (194) of the enlarged bores (72) and (124). Thus, as the hub portions (36) and (46) pass through the cushion seals (74) and (126) a substantially air tight seal is formed. The air tight seal causes the air remaining in the body portion (112) to pass through bores (96) and (150), by cushion screws (94) and (148) and exit through bores (86) and (140). This exiting of the air controls the speed of the piston (30) as it moves through its stroke.

The switches (24) and (26) are low profile proximity switches whose outputs are adapted to be connected to computer numerical controlled (CNC) systems. Generally, the switches (24) and (26) have a probe (196) and (198) extending into bores (76) and (130), respectively, for sensing the stroke of the air cylinder (10). Not to be limited, switches like those manufactured by Namco, Cleveland, Ohio, Model Series No. EE230 provide satisfactory results. The switches (24) and (26) are secured onto the planar surfaces (84) and (138) of the bosses (82) and (136) by conventional means, such as screws. The switches (24) and (26) have a planar bottom surface for nesting on planar surfaces (84) and (138). The probes (196) and (198) sense, either magnetically, electrically or by radio frequency, the hub portions (36) and (46) as the hub portions (36) and (46) pass underneath the probes (196) and (198). The distance between the probes (196) and (198) and the hubs (36) an (46) is substantially equal. This equal distance enables the same proximity switches to be used on both ends and caps of the cylinder. As the hub portions (36) and (46) pass under the probes (196) and (198), the probe transmits a signal back to the computer which, in turn, enables the cylinder to oscillate back and forth through its operating stroke.

Both of the end caps (14) and (16) are formed, by conventional processes such as forging, molding, or pouring, from a ductile metallic material. Preferably, the material is ductile iron. Ductile material end caps of casted shapes substantially reduces the overall weight of the air cylinder (10). Also, the ductile material provides the end caps with built-in lubricity characteristics. These lubricity characteristics enable the mounting mechanisms to move freely in their mounts without excessive auxiliary lubricants, such as grease, oil, graphite, or the like.

Figure 7:
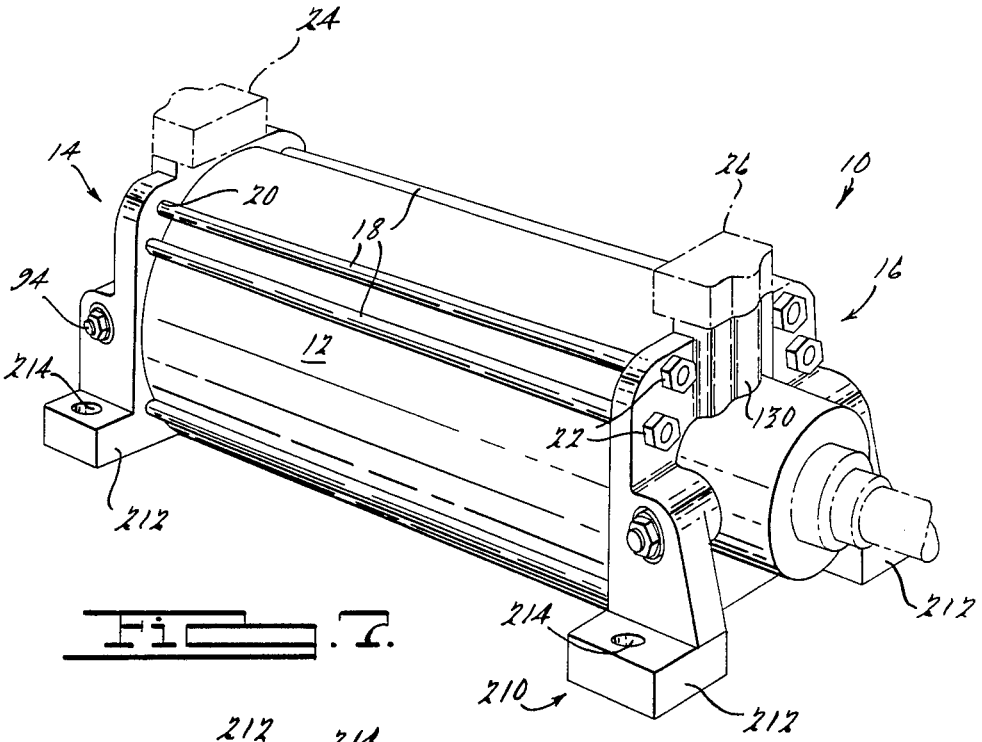
FIG. 7 is a perspective view of another embodiment made in accordance with the teachings of the present invention.
Figure 8:
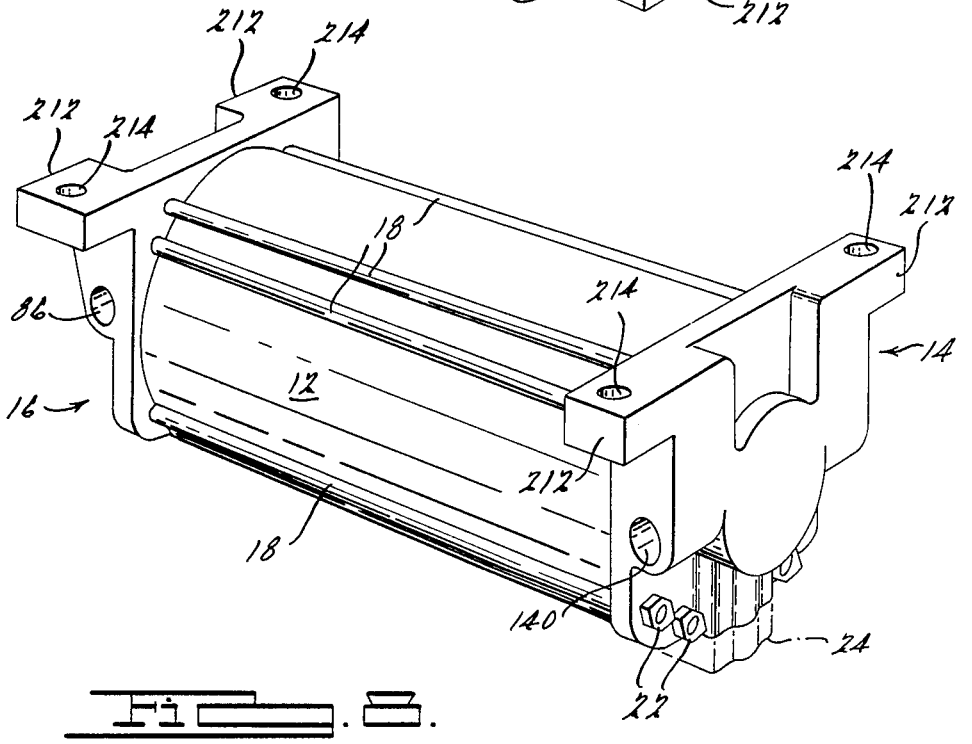
FIG. 8 is a perspective view of the embodiment of FIG. 7 taken from a bottom rear corner thereof.
Figure 10:
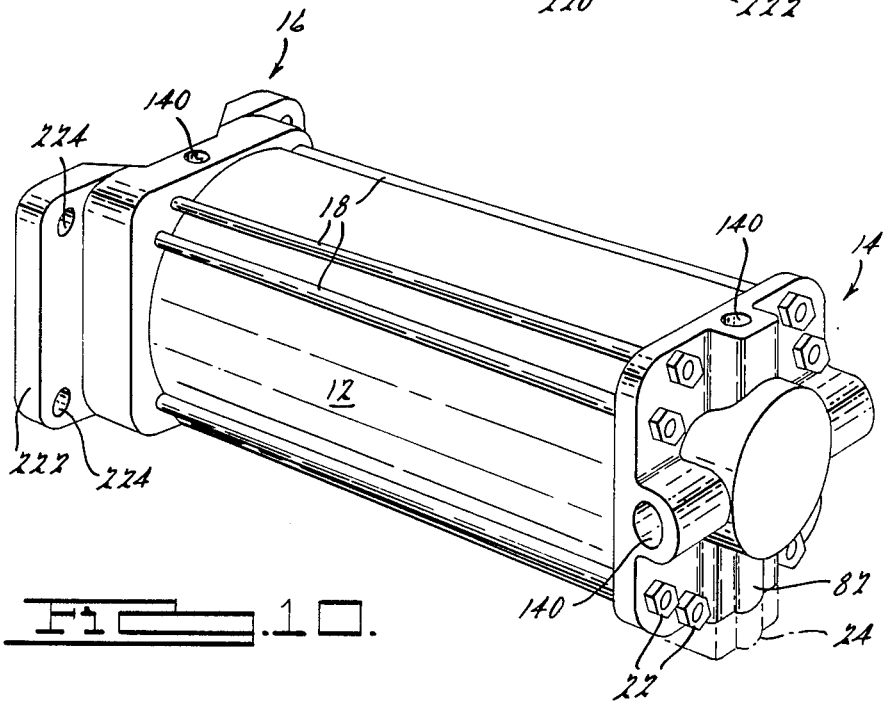
FIG. 10 is a perspective view of the embodiment of FIG. 9 taken from a bottom rear corner thereof.

FIGS. 7–8, and 10 illustrate several different mounting embodiments utilized in the present invention.

FIGS. 7–8 illustrate a foot mount (210). The foot mount (210) is formed in the end caps (14) and (16) and is comprised of a pair of members (212) projecting from the bottom end of the end caps (14) and (16). Preferably, the members (212) have a rectangular shape and an aperture (214) through the members (212) for enabling securement of the air cylinder (10).

Figure 9:
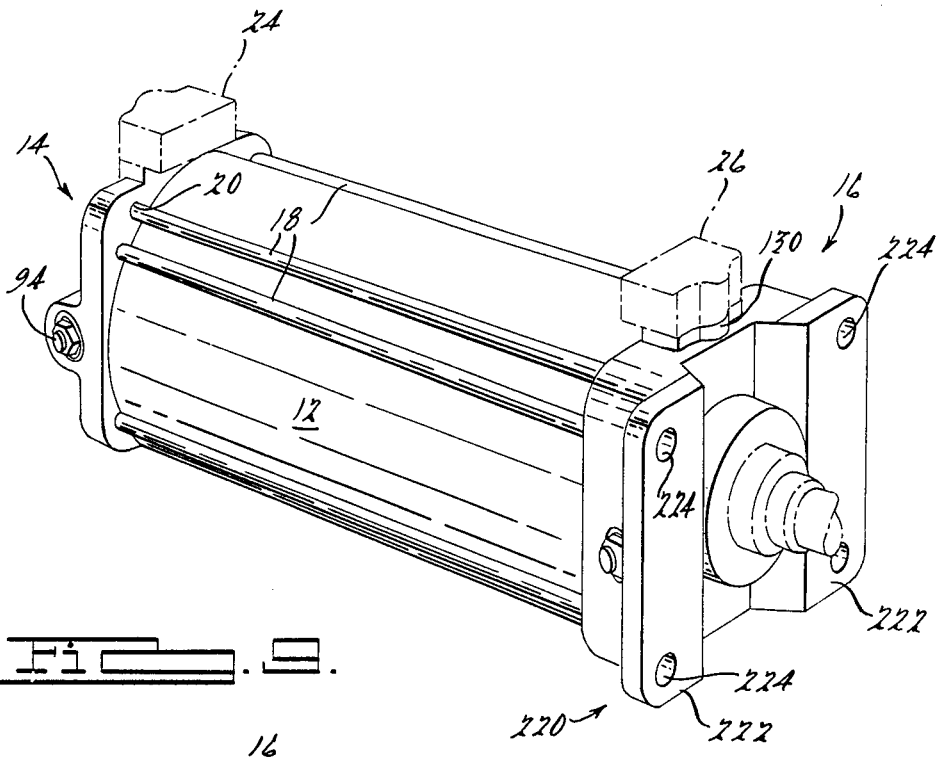
FIG. 9 is a perspective view of another embodiment made in accordance with the teachings of the present invention.

FIGS. 9–10 illustrate a flange mount (220). The flange mount (220) may be formed in either of the end caps (14) and (16) and is comprised of a pair of flange members (222) projecting from the sides of the end cap (16). Preferably, the flange members (222) are rectangular and extend beyond the body portion (12) of the air cylinder (10) and have a plurality of apertures (224) for enabling securement of the cylinder.

While the above summarizes the present invention, it will become apparent to those skilled in the art that modifications, variations, and alterations may be made without deviating from the scope and spirit of the present invention as described and claimed herein.

What is claimed is:

1. A fixture cylinder that permits reliable and accurate use of proximity switches with the same fixed probe length on both end caps, the cylinder comprising:

a body for housing a piston assembly having a piston head, a piston rod and a pair of hubs on opposite sides of the piston head; the piston assembly being slideably mounted in a bore having a piston axis in the body;

first and second end caps on opposite ends of the body, each end cap having a plurality of outer edges as viewed along the piston axis, each end cap having a generally flat mounting surface on one edge thereof and a perpendicularly extending aperture therein communicating with the bore in the body, each end cap further including mounting means for attachment to external support structure to hold the cylinder in a desired orientation;

two substantially identical proximity switches, each switch having a generally flat mounting surface and a fixed length probe extending perpendicularly therefrom; and means for securing each proximity switch to its respective end cap so that the probe extends into the aperture and the mounting surface of the proximity switch abuts the mounting surface of the end cap while keeping the aperture otherwise free of adjustable mechanisms which could affect the distance that the probe extends towards the piston hub whereby the gap between each probe and the piston hub is repeatably accurately defined.

2. The cylinder of claim 1 wherein each end cap includes cushion means for regulating the exiting of compressed air in the bore between the piston head and end cap as the piston head approaches the end cap.

3. The cylinder of claim 2 wherein the cushion means comprise a second bore in each end cap for receiving the hub and communicating with ambient air, an air passageway in the end cap between the second bore and the bore in the body, a regulating screw in the air passageway, and a seal for engaging the hub as it enters the second bore.

4. The cylinder of claim 1 wherein the mounting surfaces in both end caps are spaced substantially the same distance from the piston axis, said distance being different than the distance between at least one other edge of the end caps and the piston axis.

5. The cylinder of claim 4 wherein said mounting surface on each end cap is provided by a boss projecting away from an edge of the end cap.

6. The cylinder of claim 5 wherein each end cap has a relatively thin wall portion extending transversely to the piston axis, and wherein at least one end cap has an integral nose portion of reduced cross section projecting outwardly concentrically with the piston axis, with an end of the piston rod extending therethrough.

7. The cylinder of claim 6 wherein said boss and said mounting means are integrally formed with the same material as the wall portion and nose portion of the end cap.

8. The cylinder of claim 7 wherein each end cap is casted from ductile material.

9. The cylinder of claim 8 wherein said material is iron.

10. The cylinder of claim 1 wherein said means for securing the proximity switches comprise a plurality of screws extending through the proximity switches into the end caps in the areas of said mounting surfaces on opposite sides of said aperture.

11. The cylinder of claim 1 wherein each end cap further comprises:

means in each end cap for providing said bore of the body with inlet and outlet air on one side of the piston head.

12. The cylinder of claim 1 wherein said mounting means is selected from the group of clevis mounts, flange mounts, trunion mounts, and foot mounts.

13. The cylinder of claim 1 which further comprises a lubrication reservoir in the piston head for lubricating the bore of the body.

14. The cylinder of claim 1 wherein each hub has substantially the same diameter.

15. A fixture cylinder that employs substantially identical proximity switches without requiring spacers on the end caps, said cylinder comprising:

a cylindrical body for housing a piston assembly, said piston assembly including a piston head, a piston rod and a pair of hubs of substantially the same diameter on opposite sides of the piston head, the piston assembly being slideably mounted about a piston axis in a bore in the body;

a first end cap attached to one end of the body and extending transversely to the piston axis, said first end cap being of a unitary construction and including generally square wall portion adjacent to the body and having four edges, a nose portion of reduced cross section relative to the wall portion and extending away therefrom concentrically with the piston axis through which the piston rod extends, and the end cap further including a integrally formed boss raised up from one edge of the plate portion, the boss providing a generally flat mounting surface for one of the proximity switches, the end cap having an aperture extending from the mounting surface perpendicularly into the bore, the end cap further including a first bore for receiving the piston hub and communicating with ambient air through a port, a cushion seal concentrically mounted about the piston axis inboard of the aperture for engaging said one piston hub, an air passageway between the first bore in the end cap and the bore in the body, a regulating screw in the air passageway, and the first end cap further having a mounting mechanism for attachment to external support structure;

a second end cap mounted to an opposite end of the body, said end cap being of a unitary construction including a wall portion extending transversely to the piston axis and having four outer edges, the end cap further including an integrally formed boss raised up from one edge of the wall portion for providing a mounting surface for a substantially identical proximity switch, the end cap further including an aperture extending perpendicularly from the mounting surface into the bore in the body, the second end cap further including a second bore for receiving the opposite piston hub and communicating with ambient air through a port, a second cushion seal inboard of the aperture for engaging the opposite hub, an air passageway between the second bore in the second end cap and the bore in the body, a second regulating screw in the passageway, and the second end cap having a mounting mechanism for attachment to external support structure cooperating with the mounting mechanism in the first end cap to hold the cylinder in a desired orientation;

the mounting surfaces on the bosses in the first and second end caps being substantially coplanar and spaced equidistant from the piston axis;

a first proximity switch having a flat lower mounting surface and a fixed length probe extending perpendicularly therefrom;

a second proximity switch substantially identical to the first proximity switch;

a first pair of screws extending downwardly through the first proximity switch into the first end cap in the area of said boss therein on opposite sides of the aperture serving to bring the lower mounting surface of the proximity switch into precise abutting relation with the mounting surface provided by the boss so that the probe extends freely through the aperture toward the piston bore;

a second pair of screws extending downwardly through the second proximity switch into the second end cap in the area of the boss therein on opposite sides of the aperture serving to bring the lower mounting surface of the second proximity switch into precise abutting relationship with the mounting surface provided by the boss in the second end cap so that the probe extends freely through the aperture toward the piston bore; and whereby the same proximity switches can be used to precisely detect the position of the piston rod hubs without requiring the use of spacers between the proximity switch and the end caps.

* * * * *